United States Patent [19]

Barthlome

[11] Patent Number: 4,763,893

[45] Date of Patent: Aug. 16, 1988

[54] PUMPING UNIT FOR THERAPEUTIC HAND EXERCISER

[76] Inventor: Donald E. Barthlome, 313 Orange Plank Rd., Hampton, Va. 23669

[21] Appl. No.: 933,154

[22] Filed: Nov. 21, 1986

Related U.S. Application Data

[63] Continuation-in-part of Ser. No. 697,385, Feb. 1, 1985, Pat. No. 4,671,258, which is a continuation-in-part of Ser. No. 570,091, Jan. 12, 1984, abandoned.

[51] Int. Cl.[4] ..... A61H 1/00

[52] U.S. Cl. ..... 128/24 R; 91/39; 60/411

[58] Field of Search ..... 272/130; 128/25 R, 26 B; 91/39; 60/412, 411; 92/92; 128/24 R, 24.1, 64, 38, 39, 40, 25 B

[56] References Cited

U.S. PATENT DOCUMENTS

| | | | |
|---|---|---|---|
| D. 188,423 | 7/1960 | Fox | D21/198 |
| 2,225,308 | 12/1940 | Kroll | 128/24 R |
| 2,383,193 | 8/1945 | Herbert | 91/39 X |
| 2,384,202 | 9/1945 | Smith | 91/39 |
| 2,674,231 | 4/1954 | Erickson | 91/39 |
| 3,020,908 | 2/1962 | Daniels et al. | 128/26 |
| 3,167,067 | 1/1965 | Rand | 128/24 R |
| 3,245,405 | 4/1966 | Gardner | 128/87 R |
| 3,392,723 | 7/1968 | Calvin | 128/24 R |
| 3,457,912 | 7/1969 | Clark et al. | 128/26 |
| 3,527,207 | 9/1970 | Gottfried | 128/24 R |
| 3,581,740 | 6/1971 | Sherbourne | 128/77 |
| 3,756,222 | 9/1973 | Ketchum | 128/26 |
| 3,760,801 | 9/1973 | Borgeas | 128/25 R |
| 3,892,229 | 7/1975 | Taylor et al. | 128/24 R |
| 3,896,794 | 7/1975 | McGrath | 128/24 R |
| 3,937,215 | 2/1976 | Barthlome | 128/26 |
| 3,942,518 | 3/1976 | Tenteris et al. | 128/24 R |
| 4,030,488 | 6/1977 | Hasty | 128/24 R |
| 4,086,920 | 5/1978 | Miniere | 128/24 R |
| 4,186,732 | 2/1980 | Christoffel | 128/24 R |
| 4,197,837 | 4/1980 | Tringali et al. | 128/40 X |
| 4,296,743 | 10/1981 | Lasley | 128/40 X |
| 4,375,217 | 3/1983 | Arkans | 128/24 R |
| 4,671,258 | 6/1987 | Barthlome | 128/26 |

*Primary Examiner*—Richard J. Apley
*Assistant Examiner*—Howard Flaxman
*Attorney, Agent, or Firm*—Sandler & Greenblum

[57] ABSTRACT

The present invention provides a pump assembly which is used to control the amount of extension and flexion of an inflatable pouch which is used to exercise the fingers, hand, or other limb of a patient. A diaphragm pump is provided together with a rotatable cycling valve and a metering control valve to supply air to the diaphragm pump and to cyclically inflate and deflate the pouch upon which a patient's hand is positioned. Manual overrides are provided to inflate and deflate the pouch to a desired degree, dependent upon the position of the hand of the patient as well as the amount of flexion and extension desired and which the patient is capable of. A method of cyclically inflating and deflating the pouch is also provided.

36 Claims, 3 Drawing Sheets

PUMPING UNIT FOR THERAPEUTIC HAND EXERCISER

BACKGROUND OF THE DISCLOSURE

1. Related Applications

This application is a continuation-in-part of U.S. patent application Ser. No. 697,385 now U.S. Pat. No. 4,671,258, filed on Feb. 1, 1985, which is in turn a continuation-in-part of U.S. patent application Ser. No. 570,091 now abandoned, which was filed on Jan. 12, 1984. The disclosures of both these applications are expressly incorporated by reference herein.

2. Technical Field of the Invention

The present invention generally relates to a pumping system for therapeutic limb exercisers, and more specifically to a pumping system which is adapted to be used by an operator in a controlled fashion to control the extent of exercise provided to a limb, and particularly to the fingers and the hand of a patient. This device can be used with any type of limb of a patient, but preferably and most advantageously is for exercising a hand and fingers.

3. Discussion of Prior Art

There have been several attempts to develop limb exercises using an inflatable pouch. Applicant's own prior patent, U.S. Pat. No. 3,937,215, discloses a cyclical therapeutic hand exerciser which is adapted to move the fingers of a user in accordance with inflation and deflation of selected bag-like or pouch-like portions. This apparatus is designed to pull the fingertips of a patient and to curl them inwardly towards the palm of the patient upon inflation and deflation of the pouch(es). Air pressure inflates a splint-like upper member to straighten the fingers, and when this splint-like member is deflated and a wrist pouch inflated, a flap is tightened to pull the fingertips downwardly and to curl the fingers inwardly towards the palm of the user.

CLARK et al., U.S. Pat. No. 3,457,912, is a complex system involving a pneumatically actuated apparatus for extending and closing the fingers of a patient. The apparatus utilizes inflation to extend the fingers but depends upon driven cords to pull individual fingers of a glove to close the fingers.

SHERBOURNE, U.S. Pat. No. 3,581,740, discloses an apparatus whose use is limited to straightening the fingers of a patient, and no motion is imparted to the fingers to close them or to repeat an exercising cycle.

KETCHUM, U.S. Pat. No. 3,756,222, discloses a hand splint for exercising fingers which includes a plurality of flexible elements for manipulating the fingers of a patient.

DANIELS et al., U.S. Pat. No. 3,020,908, discloses a splint which can be attached to the hand of a patient to manipulate and exercise the same.

None of these devices, however, are capable of manipulating body portions in a controlled fashion as with the present invention; and none disclose a pump which produces the advantages of the pump of the present invention.

SUMMARY OF THE INVENTION

It is accordingly a general object of the present invention to provide a new and improved exerciser for limbs, and particularly for hands and fingers of a patient, which is adapted to permit an operator to exercise the hand of patient in a controlled variable and efficient fashion.

It is a further object of the present invention to provide a new and improved exerciser for the hand/fingers of a patient which is capable of exercising the joints of the hand with a constant, passive, cyclical motion, or in a manner so as to provide only extension or only flexion of an injured hand.

Still another object of the present invention is to provide a new and improved hand and finger exerciser and pump assembly which permits an operator/patient to begin an exercise session in any position that the diseased or injured hand of a patient may be found.

Yet a further object of the present invention is to provide a new and improved exerciser for exercising the fingers and hands of a patient which is capable of providing a degree of cyclical flexure about the position in which a limb is found, which cyclical flexure can be controlled by the operator.

Still another object of the present invention is to provide a new and improved exerciser for automatically exercising the fingers/hand of a user which includes adjustment means for maintaining an exercise cycle about a selected location and at a selected magnitude/-frequency for an indefinite period of time.

Yet a further object of the present invention is to provide a new and improved exerciser for exercising the fingers/hand of a user which is capable of providing a low amplitude, high frequency vibration which is transmitted from a pumping unit to a pouch and the hand being exercised in order to desensitize or reduce pain for the patient, thus permitting a quicker and more effective recovery for the patient.

All of the above objects and advantages of the present invention can be provided for in a therapeutic hand exerciser which comprises an inflatable pouch which is adapted to extend or straighten the fingers of the hand of a patient when inflated and which flexes or bends the fingers (under the urging of one or more springs) when air is removed. Again, while this application will be mainly directed to the use of such an apparatus for straightening the fingers of the hand of a patient, it could equally well be applied to other joints if desired. A pumping unit serves to provide a necessary degree of (cyclical) inflation and deflation, as required by the pouch, in order to achieve all of the above objects. The pumping unit comprises a diaphragm pump with vacuum and pressure lines which enter a cycling valve separately, but leave the cycling valve as a single line. The cycling valve thus serves to alternately connect a single discharge line first to the entering pressure line and then to the entering vacuum line. The single discharge line is then connected to a metering valve, which is controlled by the operator, and which meters air flow into and out of the pouch to provide cyclical motion. The pressure line from the pump is also connected to a toggle valve which, in turn, is connected to an inlet line extending into the pouch. This valve and this inlet line bypass the cycling valve to permit manual inflation of the pouch by an operator when desired. The inlet line to the pouch is also connected to a second toggle valve which, when opened, will permit manual deflation of the pouch.

The vacuum line, in addition to being connected to the cycling valve, is also connected to a second metering valve which has one port open to the atmosphere. When the operator of the pump/exerciser adjusts a first metering valve, which metering valve serves to meter air flow into and out of the pouch, the operator will also be adjusting the vacuum line (or second) metering valve. The adjustment of the vacuum line metering valve is achieved via a drive belt and a pair of timing pulleys which connect these two valves. The vacuum line to the pump is also connected to a third valve also controlled by the operator, which is open to the atmosphere and which serves to adjust, as necessary, the degree of extension and flexion of the pouch in a desired fashion by admitting different amounts of air to the pumping system.

The present invention is provided for in a first aspect thereof by a pumping assembly which is adapted for use with a moveable and inflatable pouch on which the limb of a patient is adapted to be positioned; the pumping assembly comprises a diaphragm pump comprising means for providing pressurized air in a first line and means for creating a vacuum in a second line attached to an opposite side of said pump from said first line. The first line is connected to a pressure side of said pump at one end and at a second end to a cycling valve, and the second line is connected at a first end to a vacuum side of said pump and at a second end to said cycling valve. At least one third line is fluidically connected to said cycling valve, a first metering valve controls the amount of air conducted through said at least one third line, and means are provided for fluidically connecting said at least one third line to said inflatable pouch. The pumping assembly has a hose which is fluidically attached to said at least one third line at a first end of the hose, and a second end of said hose is attached to the inflatable pouch.

The at least one third line comprises third, fourth, fifth and sixth lines, wherein a solenoid valve is positioned between said fifth and sixth lines, said first metering valve being positioned between said third and fourth lines. The assembly further comprises a housing, said housing including a control panel, said solenoid valve being actuatable by a toggle switch located on said control panel. The third line is connected to said cycling valve by seventh and eighth lines, said seventh line being adapted to be selectively fluidically communicated with said second line by rotation of said cycling valve and said eighth line being adapted to be selectively fluidically communicated with said first line by rotation of said cycling valve.

The cycling valve comprises a body and two apertures located on one side of said valve body for receiving said first and second lines, and two apertures located on a second side of said valve body for receiving two outgoing lines which are fluidically connected to said at least one third line. The said cycling valve includes a shaft having two axially spaced apart holes which are perpendicular to each other, said shaft being adapted to be cyclically and rotatably operated to selectively fluidically connect said second and seventh lines and said first and eighth lines, respectively; and the cycling valve comprises means for producing a fluctuating pressure along said third line. A second metering valve comprises means for controlling the intake of atmospheric air into said pumping assembly, and the first and second metering valves are commonly controlled by a single metering valve control knob.

The metering valve control knob comprises a shaft attached to said first metering valve, a first timing pulley positioned about said first metering valve shaft, a second shaft attached to said second metering valve, and a second timing pulley positioned around said second metering valve shaft, said apparatus further comprising a timing belt positioned around said first and second timing pulleys.

The diameter of the said second pulley is greater than the diameter of said first pulley, and the second valve is attached via a ninth line to said second line, wherein said single metering valve control knob comprises means for controlling flexure and extension of said pouch by controlling the amount of air admitted to said assembly.

A relief valve is positioned between said cycling valve and said pump along said first pressurized line, and a first regulating valve is positioned along said first line, said first regulating valve comprising means for releasing a predetermined amount of pressurized air to the atmosphere. The predetermined amount of pressurized amount of air released to the atmosphere comprises a base line amount established so that pouch extension and flexure will be equal for each opening and closing cycle of said pouch. An adjustment valve is located along the suction side of said pump along a ninth line which is fluidically connected to said second line for receiving additional air from the atmosphere. This adjustment valve is always open by at least a predetermined minimum amount; and an adjustment valve control knob is provided for controlling air intake through said adjustment valve, said adjustment valve control knob thereby comprising means for altering the extension and flexure of the pouch.

The assembly further comprises means for bypassing operation of said cycling valve and said first metering valve, said bypassing means comprising a first toggle valve located along said first line, wherein said toggle valve, when opened, comprises means for fluidically connecting said first line to said pouch. This first toggle valve is connected by at least one line to a hose which is directly connected to said pouch, and a second toggle valve is fluidically connected to said at least one third line and comprises means, when open, for discharging air from said pouch to deflate said pouch.

The pumping assembly further comprises means for manually cntrolling deflation of said pouch, and means for vibrating said pouch when the limb of a patient is attached to said pouch. The first and second toggle valves, when open, permit the pouch to be vibrated. A second regulating valve is attached to said second toggle valve to regulate the amount of air discharged by said second toggle valve.

In another aspect of the present invention, a method of inflating and deflating an inflatable pouch is provided for exercising the hand of a patient positioned on the pouch. The method comprises using a diaphragm pump to provide pressurized air to a first line and a vacuum to a second line, selectively connecting said first and second lines to a third line with a rotatable cycling valve, and metering the amount of pressurized air conducted through said third line between a pouch and the cycling valve by using a metering valve. The method further comprises cyclically controlling the amount of air taken into said second line simultaneously with metering said pressurized air, and preventing complete extension or flexion of said pouch by opening a first regulating valve positioned along said first line to release pressurized air to the atmosphere in an amount sufficient to permit extension and flexion of said pouch during each cycle of operation of said pumping assembly to be equal.

The method of inflating and deflating an inflatable pouch uses a second air intake valve to further adjust the amount of air flow to the suction side of said pump, along said second line; and the method also includes bypassing said cycling valve and said metering valve by directly connecting said first pressurized line with said pouch via an open first toggle valve. The method can also further comprise manually discharging air via a second toggle valve which is directly fluidically connected to said pouch, as well as vibrating said pouch by sending pressurized air pulses along said first line and into said pouch. The pouch is vibrated by opening said first and second toggle valves, and the degree of opening of the second toggle can be adjusted by using a regulating valve.

The above objects, features, and advantages of the present invention will become more fully apparent to those of ordinary skill in the art to which the present invention pertains upon further review of this application.

BRIEF DESCRIPTION OF THE DRAWINGS

All of the details, features and advantages of the present invention will become more fully apparent to those of ordinary skill in the art to which the present invention pertains from a review of the following brief description of the drawings, together with a review of the detailed description of the drawings which follow, in which like reference numerals refer to similar parts throughout the several views of the application, and wherein.

DETAILED DESCRIPTION OF THE DRAWINGS

Figure 1:
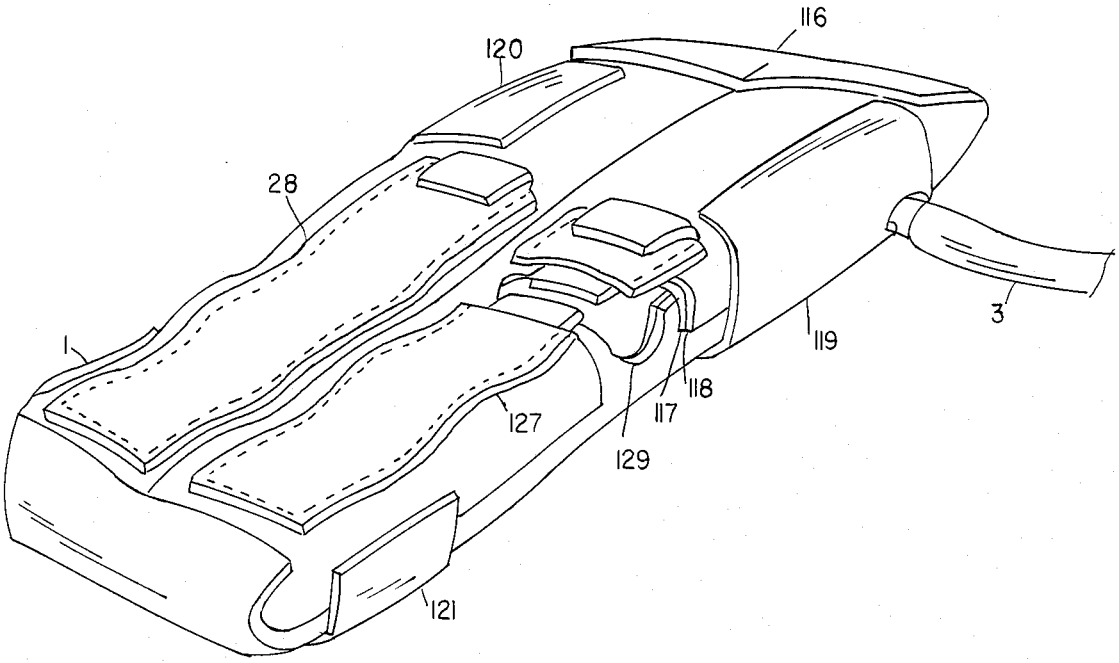
FIG. 1 is a perspective view of a finger/hand exerciser or flexor having a pouch, when in its fully inflated position.
Figure 2:
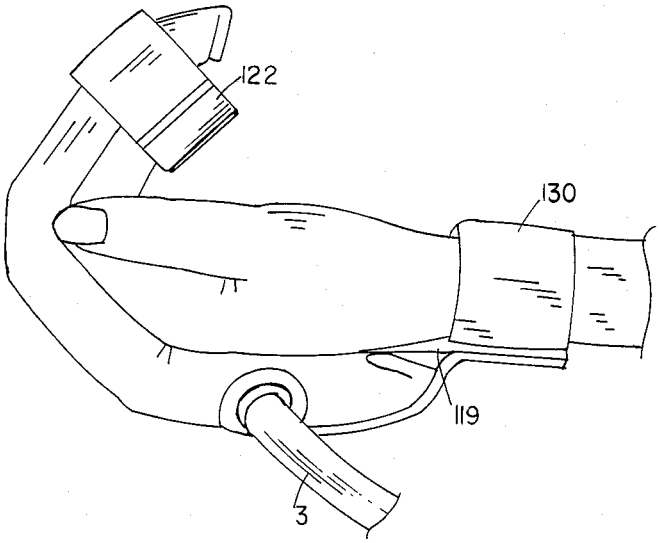
FIG. 2 is a side view of the pouch of FIG. 1, showing a hand attached to the exerciser.

One embodiment of a finger flexor or exerciser, as illustrated in parent application Ser. No. 697,385, is illustrated in FIGS. 1 and 2. As shown in FIG. 1, two layers of material 117 and 118 are laminated together. This laminated or bonded material is then folded over and the edges sealed to form a single loop and a closed pouch. The ends of the single loop are sealed and folded over, and a row of stitches are sewn in a parallel fashion to the bonded edge and located in the center of the large loop so as to form two small loops from the single large loop. The pouch 116 could alternately be fabricated from a rectangular piece of material 117, with two edges on one side of material 117 being overlapped slightly and then bonded together.

The sewn stitches are then sealed with adhesive, and another layer 118 of material is bonded to the first layer. Two pieces of relatively hard (or hook) Velcro patches 119 and 120 are then attached to the side of pouch 116, at the end of which an inflating tube 131 is attached. Patches 119 and 120 are then used to secure soft (or loop) Velcro wrist strap 130 to pouch 116.

Hard Velcro patch 121 is attached to the bottom surface of pouch 116 at the opposite end of the pouch from patches 119 and 120. Patch 121 is used to secure a finger strap 122 (shown in FIG. 2) to pouch 116. The finger strap comprises a rectangular piece of plexiglass or other appropriate rigid material, which material is then covered with a relatively soft material piece similar to the material used for layers 117 and 118.

Pockets or housings 127 and 128 are then attached to the top surface of pouch 116 to removeably mount a spring steel 121 in this embodiment. The spring permits the flexor/exerciser to bend a plurality of joints on each finger whenever the pouch is non-inflated; and the apparatus can be used to bend all of the fingers by providing a plurality of springs and a larger width pouch than that illustrated in FIG. 1.

This apparatus permits more than one finger to be exercised simultaneously, as illustrated in FIG. 2. When pouch 116 is inflated to match the shape of the fingers, the fingers are secured to pouch 116 using finger strap 122. When the pouch is in its straight, inflated position, as illustrated in FIG. 1, a soft Velcro wrist strap 130 is placed over the wrist and secured to hard Velcro patches 119 and 120, as shown in FIG. 2. When the pouch is deflated, the natural biasing action of the spring(s) causes the fingers to be curled upwardly, as illustrated in FIG. 2.

Figure 3:
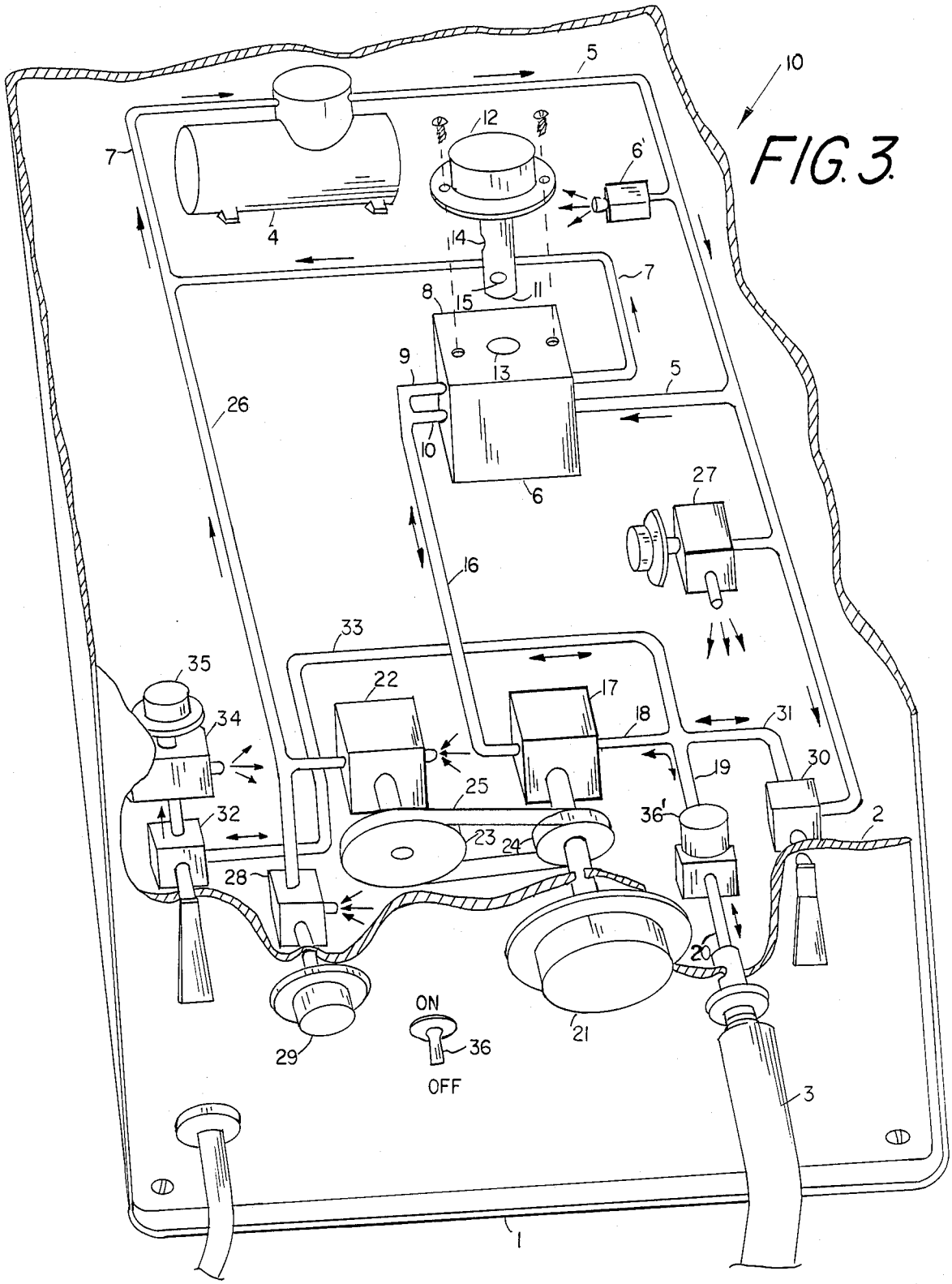
FIG. 3 is a cut-away perspective view of a pumping unit used with the hand exerciser of FIGS. 1 and 2.

A pumping unit as illustrated in FIG. 3 is adapted to be used with the exerciser of FIGS. 1 and 2, or with any other inflatable limb exerciser to which fluidic communication is provided by a connection through a tube such as tube 3 illustrated in FIG. 3. Pumping assembly 10 comprises a housing 1 having a control panel 2. A hose 3 connects the pumping assembly 10 to pouch 116 as illustrated in FIGS. 1 and 2. Air pressure and vacuum are provided by a diaphragm pump 4, and a first line 5 connects the pressure side of pump 4 to relief valve 6' so as to ensure that the pressure in the system will not exceed a maximum predetermined value. Line 5 also connects the pressure side of pump 4 to cycling valve 6, and a second line 7 is also connected to the valve at one end and at a second end to the second side of pump 4. Cycling valve 6 comprises a valve body 8 which has two parallel holes cut therein on one side which extend to a second body side and which connect pressure lines 5 and 10 and vacuum lines 7 and 9, respectively. A third hole 13, which is designed to accept shaft 11 of timing motor 12, is cut in the top of the body and is provided to intersect the two parallel bores in the block. Holes 14 and 15 of shaft 11 are then cut in a perpendicular fashion with respect to each other and are positioned so as to selectively interface with the parallel bores in the valve body that receive the pressure and vacuum lines.

An adequate seal is provided between rotatable shaft 11 and valve body 8 by virtue of the close tolerance between the two members. This type of seal permits air to bleed outwardly from line 5, between the shaft and the valve body, to the atmosphere, thereby eliminating the problem of attempting to start diaphragm pump 4 against a pressure head as well as problems caused by degradation of system performance as would occur, e.g., during gradual wearing of an "O" ring seal.

As timing motor 12 rotates shaft 11, the vacuum and pressure lines 5 and 7 are alternately opened and closed to discharge lines 10 and 9, respectively. This produces a fluctuating pressure in line 16 which is formed by the joiner of lines 9 and 10. Line 16 (the at least one third line) is connected to a first metering valve 17, which is in turn connected to the pouch by lines 18, 19, 20 (fourth-sixth lines) and hose 3. Metering valve 17, which is normally closed, is controlled by an operator via rotation of control knob 21. As this knob is rotated, metering valve 17 permits a continually increasing amount of air to pass to and from the pouch. In addition to controlling valve 17, rotation of knob 21 also increases the opening in second metering valve 22 which, like valve 17, is also normally closed. The opening of valve 22 by turning knob 21 is achieved by a set of timing pulleys 23 (second) and 24 (first) and a timing belt 25. The diameter of pulley 23 is proportionally larger than pulley 24 so that the opening in valve 22 will always be somewhat less than the opening in valve 17. In this fashion, with the (second) suction line 7 closed and (first) pressure line 5 opened with cycling valve 6, most of the air passing through pump 4 and metering valve 17 towards the pouch will pass through valve 22 from the atmosphere. In this fashion, only relatively small amounts of air will be available to pressurize the pouch for low settings on control knob 21.

As knob 21 is turned higher to increase the flexure of the pouch, larger amounts of air will pass through valve 22 and line 26 (ninth line), and the upper portion of line 7, to pressurize pump 4 and conduct air to the pouch. This above description outlines how normal cycling is achieved.

However, if the pumping unit consisted only of the elements described above, the pressure in the pouch would gradually increase with each inflating/deflating cycle until the pouch is fully pressurized with no cyclical motion left. This would occur because it is easier to place a predetermined amount of air into a container, through a given opening, than to draw the same amount of air outwardly from the container. Therefore, pressurized air leaving the pump and conducted towards the pouch must be reduced by a measured amount relative to the amount of pressurized air entering the pump on the suction side thereof. In other words, while the ability of the pump to extract air from the pouch remains unchanged, the ability of the pump to pressurize the pouch must be reduced by a predetermined degree. This is achieved by installing a first regulating valve 27 in line 5. To determine the amount of pressurized air which must be released to the atmosphere, cyclical action of the pouch is initiated, and thereafter regulating valve 27 is gradually opened until the amount of extension and flexion of the pouch for one cycle is equal to that for all subsequent cycles. In other words, in such condition the apparatus prevents the cycle from drifting towards total extension or towards total flexion, thus preventing the pouch from eventually becoming completely open or completely closed.

Once the setting on valve 27 is established, it is permanent, and no further adjustment will need to be made to valve 27 throughout the life of the unit. This is thus a major adjustment to the apparatus, needed to balance the air flow, and establishes a baseline value for the pouch. This adjustment is made on a new pumping unit, starting with a "cold" pump, i.e., a pump maintained at room temperature, and with no hand positioned on the pouch.

When the unit is placed into service, however, the unit may be started with a "hot" pump, there may be a hand positioned on the pouch, and the components of the device may have been degraded, dependent upon the age and use of the unit. Accordingly, an external adjustment may be necessary to counteract the effect of these uncontrollable variables. Such adjustment is achieved by a valve 28 which meters air flow from the atmosphere to the suction side of the pump.

A second, operational adjustment valve 28 is positioned on the suction side of the pump along line 26, whereas first adjustment valve 27 is located on the pressure side. This is done for several reasons. Firstly, for a predetermined adjustment of valve 27, the effect on the motion of the pouch will be dramatic, while a similar adjustment to valve 28 will only be slightly noticeable. This occurs because valve 27 works with dense pressurized air, whereas valve 28 works with rarefied, low pressure air. Of course, small corrections of motion are important when a patient is using the unit. Secondly, since valve 28 is always open by at least some minimum amount, it provides the pump with a source of air for initial inflation of the pouch. Accordingly, should there arise a need to either increase or decrease, even slightly, air flow to the pouch, the operator need only turn control knob 29 to adjust valve 28 in one direction to increase the flow or in a second direction to decrease the flow. Such action will effectively shift the cycle very slightly so that if extension is excessive, and therefore painful for a patient, an operator will be able to reduce the air flow and the cycle will impose less extension and more flexion on the system. If, to the contrary, flexion is excessive and unduly painful for a patient, an operator will be capable of increasing the air flow to extend the pouch and the hand positioned thereon. Before starting the cyclical action, however, control knob 29 is always positioned at the base line setting, indicated by the letter N on the dial of the pump assembly, and is then turned as may be necessary in order to satisfy the requirements of any particular patient.

During manual operation, the unit is provided with a first toggle valve 30 which permits the operator to bypass cyclical cycling valve 6 and metering valve 17, thereby sending pressurized air directly to the pouch through lines 5, 31, 19, 20 and tubing hose 3. This type of operation permits inflation of the pouch to whatever degree is necessary to match the shape of a patient's hand, and permits the operator to impose only extension on the finger/hand of the patient. Another, second toggle valve 32 is connected to the pouch by lines 33, 19, and 20, and a hose/tubing 3, and permits the manual discharge of air from the pouch through valve 34, which remains open by a predetermined amount. In this fashion, valve 32 will permit an operator to deflate the pouch, if necessary, and to match the shape of the hand or to manually impose only flexion on the fingers of the hand of a patient.

The last, final mode of operation involves a cyclical flexure with vibration. The vibration which occurs originates as a result of the action of the diaphragm pump as it emits pressurized pulses or waves down the lines, through the valves, and into the pouch. In response to these pulses or waves, the pouch will undergo a slightly vibrating motion having a frequency which is proportional to the speed of the pump. This phenomenon occurs to a noticeable degree only when both first and second toggle valves 30 and 32 are fully open, with the air from valve 32 also passing through regulating valve 34 before discharging to the atmosphere. The setting on valve 34 is then determined experimentally by operating the unit in a cyclical mode, with the indicator on control knob 29 set at V. This "V" setting is fixed for all units and has been experimentally determined as being the optimum value which will enable a typical unit to provide a maximum degree of vibration. With control knob 29 then set at N, control knob 21 set at 0, and the pouch partially inflated, with no motion occurring, both toggle valve handles for valves 30 and 32 are simultaneously raised. If the pouch tends towards closing, then control knob 35 of valve 34 is closed slightly. If, to the contrary, the pouch tends to open, then control knob 35 is opened slightly. The proper setting for valve 34 will be obtained when the pouch remains essentially motionless. The setting on valve 34 is then fixed and no further adjustment will need to be made to valve 34 throughout the life of the unit. The pouch can than be attached to the hand of a patient and control knob 21 set at a desired level for cyclical flexure with vibration.

To terminate an exercise session, or in the event of an emergency, an operator/patient need only turn switch 36 to the off position. Such action will deenergize solenoid valve 36', which will then close, thereby isolating the pouch from the pumping unit.

By using this pumping assembly with the exerciser, a mechanical system is provided which flexes and extends the fingers of injured patients with or without assistance from a therapist. The patient or therapist can select the rate and degree of flexion or extension, which can then remain constant if desired, or which can be changed by an operator or the patient.

Extension or straightening of the fingers is achieved by using the pump, with constant force springs ensuring that the pouch follows the contour of the hand.

During operation, the system is balanced, with the amount of air delivered to the pouch equaling the amount of air removed therefrom. Flexing and extension begins from any position that the hand may be in, thus permitting a wide range of use for the device. The amplitude, i.e., the amount of air cycled to and from the pouch, is set by the control knobs.

As noted above, the apparatus may be usable for other limbs and may be useful with similarly constructed elbow and knee flexors, etc.

It is to be understood that the forms of the invention described above are merely preferred embodiments of the present invention, and that various changes and modifications can be made in shape, size, or arrangement of the parts; and in equivalent means can be substituted for those illustrated and described without departing from the spirit and scope of the present invention.

What is claimed is:

1. A pumping assembly adapted for use with a moveable and inflatable pouch on which the limb of a patient is adapted to be positioned, said pumping assembly comprising:

(a) diaphragm pump comprising means for providing pressurized air in a first line of said assembly and means for creating a vacuum in a second line of said assembly, said second line being attached to an opposite side of said pump from said first line;

(b) said first line being connected to a pressure side of said pump at one end and at a second end of said first line to a cycling valve;

(c) said second line being connected at a first end to a vacuum side of said pump and at a second end to said cycling valve;

(d) at least one third line which is fluidically connected to said cycling valve;

(e) a first metering valve for controlling the amount of air conducted through said at least one third line and a second metering valve which comprises means for controlling the intake of atmospheric air into said pumping assembly, said second metering valve being positioned along said vacuum side of said pump and being fluidically connected to said pump;

(f) means for fluidically connecting said at least one third line to said inflatable pouch; and (g) first and second toggle valves which are fluidically connected to said pump for controlling, respectively, inflation and deflation of said pouch by bypassing said cycling valve.

2. A pumping assembly in accordance with claim 1 further comprising a hose which is fluidically attached to said at least one third line at a first end of said hose.

3. A pumping assembly in accordance with claim 2 wherein a second end of said hose is attached to said inflatable pouch.

4. A pumping assembly in accordance with claim 2 wherein said at least one third line comprises a plurality of additional fluidically connected lines including third, fourth, fifth and sixth lines fluidically connected, and wherein a solenoid valve is positioned between said fifth and sixth lines, said first metering valve being positioned between said third and fourth lines.

5. A pumping assembly in accordance with claim 4 further comprising a housing, said housing including a control panel, said solenoid valve being actuatable by a toggle switch located on said control panel.

6. A pumping assembly in accordance with claim 4 wherein said third line is connected to said cycling valve be seventh and eighth lines, said seventh line being adapted to be selectively fluidically communicated with said second line by rotation of said cycling valve and said eighth line being adapted to be selectively fluidically communicated with said first line by rotation of said cycling valve.

7. A pumping assembly in accordance with claim 6 wherein said cycling valve comprises a body and two apertures located on one side of said valve body for receiving said first and second lines and two apertures located on a second side of said valve for receiving two outgoing lines which are fluidically connected to said at least one third line.

8. A pumping assembly adapted for use with a moveable and inflatable pouch on which the limb of a patient is adapted to be positioned, said pumping assembly comprising:

(a) a diaphragm pump comprising means for providing pressurized air in a first line and means for creating a vacuum in a second line attached to an opposite side of said pump from said first line;

(b) said first line being connected to a pressure side of said pump at one end and at a second end to a cycling valve;

(c) said second line being connected at first end to a vacuum side of said pump and at a second end to said cycling valve;

(d) a plurality of additional fluidically connected lines including third, fourth, fifth, sixth, seventh and eighth fluidically connected lines, wherein said at least one third line is fluidically connected to said cycling valve;

(e) a first metering valve for controlling the amount of air connected through said additional lines;

(f) means for fluidically connecting said additional lines to said inflatable pouch;

(g) a hose which is fluidically attached to at least said third line at a first end of said hose, wherein a second end of said hose is attached to said inflatable pouch, said first metering valve being positioned between said third and fourth fluidically connected lines and a solenoid valve being positioned between said fifth and sixth lines;

(h) a housing including a control panel, said solenoid valve being actuatable by a toggle switch located on said control panel, said third line being connected to said cycling valve by seventh and eighth lines, said seventh line being adapted to be selectively fluidically communicated with said second line by rotation of said cycling valve and said eighth line being adapted to be selectively fluidically communicated with said first line by rotation of said cycling valve;

(i) said cycling valve comprising a body and two apertures located on one side of said valve body for receiving said first and second lines and two apertures located on a second side of said valve for receiving two outgoing lines which are fluidically connected to said plurality of lines; and (j) said cycling valve including a shaft having two axially spaced apart holes which are perpendicular to each other, said shaft being adapted to be cyclicall and rotatably operated to selectively fluidically connect said second and seventh lines and said first and eighth lines, respectively.

9. A pumping assembly in accordance with claim 8 wherein said cycling valve comprises means for producing a fluctuating pressure along said third line.

10. A pumping assembly in accordance with claim 1 wherein said first and second metering valves are commonly controlled by a single metering valve control knob.

11. A pumping assembly in accordance with claim 10 wherein said metering valve control knob comprises a shaft attached to said first metering valve, a first timing pulley being positioned about said first metering valve shaft, a second shaft being attached to said second metering valve and a second timing pulley being positioned around said second metering valve shaft, said apparatus further comprising a timing belt positioned around said first and second timing pulleys.

12. A pumping assembly in accordance with claim 11 wherein the diameter of the said second pulley is greater than the diameter of said first pulley.

13. A pumping assembly in accordance with claim 10 wherein said second metering valve is attached via a ninth line to said second line and wherein said single metering valve control knob comprises means for controlling flexure and extension of said pouch by controlling the amount of air admitted to said pump assembly.

14. A pumping assembly in accordance with claim 1 further comprising a relief valve positioned between said cycling valve and said pump along said first line.

15. A pumping assembly in accordance with claim 1 further comprising a first regulating valve positioned along said first line, said first regulating valve comprising means for releasing a predetermined amount of pressurized air to the atmosphere.

16. A pumping assembly in accordance with claim 15 wherein said predetermined amount of pressurized air released to the atmosphere comprises a base line amount established so that pouch extension and flexure will be equal for each opening and closing cycle of said pouch.

17. A pumping assembly in accordance with claim 15 further comprising an adjustment valve located along the suction side of said pump along a ninth line which is fluidically connected to said second line, said adjustment valve comprising means for receiving additional air from the atmosphere.

18. A pumping assembly in accordance with claim 17 wherein said adjustment valve is always open by at least a predetermined minimum amount.

19. A pumping assembly in accordance with claim 18 further comprising an adjustment valve control knob for controlling air intake through said adjustment valve, said adjustment valve control knob thereby comprising means for altering the extension and flexure of the pouch.

20. A pumping assembly in accordance with claim 19 wherein said toggle values means for bypassing operation of said cycling valve and said first metering valve.

21. A pumping apparatus in accordance with claim 20 wherein said first toggle valve is located along said first line and when opened comprises means for fluidically connecting said first line to said pouch.

22. A pumping assembly in accordance with claim 21 wherein said first toggle valve is connected via at least one line to a hose which is directly connected to said pouch.

23. A pumping assembly in accordance with claim 20, wherein said second toggle valve is fluidically connected to said at least one third line and comprises means, when open, for discharging air from said pouch to deflate said pouch.

24. A pumping assembly in accordance with claim 23 further comprising means for manually controlling deflation of said pouch.

25. A pumping assembly in accordance with claim 23 further comprising means for vibrating said pouch when the limb of a patient is attached to said pouch.

26. A pumping assembly in accordance with claim 25 wherein said first and second toggle valves, when open, conduct pulses of air to said pouch to thereby vibrate said pouch.

27. A pumping assembly in accordance with claim 26 further comprising a second regulating valve attached to said second toggle valve to regulate the amount of air discharged by said second toggle valve.

28. A method of cyclically inflating and deflating an inflatable pouch upon which the hand of a patient is positioned, said method comprising:

(a) using a diaphragm pump to provide pressurized air to a first line and a vacuum to a second line;

(b) selectively connecting said first and second lines to at least one third line with a rotatable cycling valve;

(c) metering the amount of air conducted through said third line between said pouch and said cycling valve by using a metering valve;

(d) controlling the amount of air taken into said second line simultaneously with metering of the air conducted through said third line; and (e) selectively bypassing said cycling valve and said metering valve by directly connecting said first line with said pouch via an open first toggle valve.

29. A method of inflating and deflating an inflatable pouch in accordance with claim 28 further comprising preventing total extension or flexure of said pouch by opening a first regulating valve positioned along said first line to release pressurized air to the atmosphere in an amount sufficient to permit extension and flexion of said pouch during each cycle of operation of said pumping assembly to be equal.

30. A method of inflating and deflating an inflatable pouch in accordance with claim 29 further comprising using a second air intake valve to further adjust the amount of air flow to the suction side of said pump along said second line.

31. A method of inflating and deflating an inflatable pouch in accordance with claim 28 further comprising manually discharging air via a second toggle valve which is directly fluidically connected to said pouch.

32. A method of inflating and deflating an inflatable pouch in accordance with claim 31 further comprising vibrating said pouch by sending pressurized air pulses along said first line and into said pouch.

33. A method of inflating and deflating an inflatable pouch in accordance with claim 32 wherein said pouch is vibrated by opening said first and second toggle valves.

34. A method of inflating and deflating an inflatable pouch in accordance with claim 33 further comprising adjusting the degree of opening of said second toggle valve by using a regulating valve.

35. A pumping assembly adapted for use with a movable and inflatable pouch on which the limb of a patient is adapted to be positioned, said pumping assembly comprising:

(a) a diaphragm pump comprising means for providing pressurized air in a first line and means for creating a vacuum in a second line attached to an opposite side of said pump from said first line;

(b) said first line being connected to a pressure side of said pump at one end and at a second end to a cycling valve;

(c) said second line being connected at a first end to a vacuum side of said pump and at a second end to said cycling valve;

(d) at least one third line which is fluidically connected to said cycling valve;

(e) a first metering valve for controlling the amount of air conducted through said at least one third line;

(f) means for fluidically connecting said at least one third line to said inflatable pouch;

(g) a second metering valve comprising means for controlling the intake of atmospheric air into said pumping assembly, said second metering valve being fluidically connected to the vacuum side of said pump; and (h) a single metering valve control knob comprising means for commonly controlling said first and second metering valves.

36. A pumping assembly adapted for use with a movable and inflatable pouch on which the limb of a patient is adapted to be positioned, said pumping assembly comprising:

(a) a diaphragm pump comprising means for providing pressurized air in a first line and means for creating a vacuum in a second line attached to an opposite side of said pump from said first line;

(b) said first line being connected to a pressure side of said pump at one end and at a second end to a cycling valve;

(c) said second line being connected at a first end to a vacuum side of said pump and at a second end to said cycling valve;

(d) at least one third line which is fluidically connected to said cycling valve;

(e) a first metering valve for controlling the amount of air conducted through said at least one third line;

(f) means for fluidically connecting said at least one third line to said inflatable pouch;

(g) a first regulating valve positioned along said first line, said first regulating valve comprising means for releasing a predetermined amount of pressurized air to the atmosphere, said predetermined amount of pressurized air released to the atmosphere comprising a base line amount established so that pouch extension and flexure will be equal for each opening and closing cycle of said pouch;

(h) an adjustment valve located along the vacuum side of said pump along an additional line which is fluidically connected to said second line, said adjustment valve comprising means for receiving additional air from the atmosphere, said adjustment valve always being open by at least a predetermined minimum amount; and (i) an adjustment valve control knob for controlling air intake through said adjustment valve, said adjustment valve control knob thereby comprising means for authoring the extension and flexure of the pouch.

* * * * *

UNITED STATES PATENT AND TRADEMARK OFFICE

CERTIFICATE OF CORRECTION

PATENT NO. : 4,763,893

DATED : August 16, 1988

INVENTOR(S) : Donald E. BARTHLOME

It is certified that error appears in the above-identified patent and that said Letters Patent is hereby corrected as shown below:

At column 10, line 24, i.e. claim 6 line 3 ] change "be" to ---by---.

At column 11, lines 18 and 19, i.e. claim 8 lines 45 and 46, change "cyclicall" to ---cyclically ---.

At column 12, line 8, i.e. claim 20 line 2 change "values means" to ---valve comprises means---.

Signed and Sealed this

Eighteenth Day of September, 1990

*Attest:*

HARRY F. MANBECK, JR.

*Attesting Officer*

*Commissioner of Patents and Trademarks*